US011738931B2

(12) United States Patent
Block

(10) Patent No.: US 11,738,931 B2
(45) Date of Patent: Aug. 29, 2023

(54) CONTAINER SYSTEM FOR CONFECTIONERIES AND NOVELTY ITEMS

(71) Applicant: Chuck Block, San Diego, CA (US)

(72) Inventor: Chuck Block, San Diego, CA (US)

( * ) Notice: Subject to any disclaimer, the term of this patent is extended or adjusted under 35 U.S.C. 154(b) by 0 days.

(21) Appl. No.: 17/222,804

(22) Filed: Apr. 5, 2021

(65) Prior Publication Data

US 2021/0309441 A1 Oct. 7, 2021

Related U.S. Application Data

(60) Provisional application No. 63/004,990, filed on Apr. 3, 2020.

(51) Int. Cl.
*B65D 81/36* (2006.01)
*A63H 3/04* (2006.01)

(52) U.S. Cl.
CPC ..... *B65D 81/365* (2013.01); *A63H 3/04* (2013.01)

(58) Field of Classification Search
CPC ..... B65D 81/365; B65D 85/60; A63H 3/00; A63H 3/04; A63H 3/005; A63H 3/16; A63H 3/46; A63B 67/10; A63B 2039/003; A63B 39/00; A63B 43/00; A63B 43/002; A63B 41/08; A61J 9/08; A61J 9/06; A47G 23/02; A47G 23/0241
USPC ..... 220/903, 737, 23.91, 920; 215/11.1, 215/11.6, 12.1, 395, 393, 384; 473/575–576, 595–596, 612, 614; 446/72, 97, 99, 101, 321, 327, 370–371, 446/373, 376; 248/102; D7/624.2, 607
See application file for complete search history.

(56) References Cited

U.S. PATENT DOCUMENTS 1,388,094 A * 8/1921 Buttigieg ..... A47F 7/03 206/457
1,668,143 A * 5/1928 Daasch ..... A63H 5/00 473/571
2,499,483 A * 3/1950 Foy ..... A63H 5/00 473/594
2,687,302 A * 8/1954 Stieglerfranka ..... A63B 43/00 473/571
3,603,023 A * 9/1971 McHugh ..... A63H 33/00 446/431
3,633,587 A * 1/1972 Hunt ..... A63H 5/00 473/594
3,679,212 A * 7/1972 Smith ..... A63F 9/0415 473/594
3,889,950 A * 6/1975 Kasravi ..... A63H 33/18 383/117
4,124,135 A * 11/1978 Weder ..... B65D 81/365 220/834
4,248,424 A * 2/1981 Judkins ..... A63B 67/18 273/DIG. 7
D287,988 S * 1/1987 Billinghurst ..... D21/468
(Continued)

*Primary Examiner* — Chun Hoi Cheung
*Assistant Examiner* — Brijesh V. Patel
(74) *Attorney, Agent, or Firm* — Donn K. Harms

(57) ABSTRACT

A container candy or game components is provided. The container has an elastic exoskeleton in the shape of an animal or object. A stretchable opening formed in the sidewall of the exoskeleton allows positioning of a housing holding the candy or game components within an interior chamber of the elastic exoskeleton in a biased contact with the exterior of the housing which holds two portions of the housing engaged while positioned within the interior chamber.

8 Claims, 8 Drawing Sheets

(56) References Cited

U.S. PATENT DOCUMENTS 4,645,471 A * 2/1987 Herring ..... A63H 1/20 446/431
4,795,033 A * 1/1989 Duffy ..... B65D 85/34 206/524.1
5,209,345 A * 5/1993 Haugabook ..... G09B 19/00 206/1.5
5,219,162 A * 6/1993 Orbanes ..... A63B 43/00 473/571
5,476,408 A * 12/1995 Hoeting ..... A63H 5/00 446/419
5,746,637 A * 5/1998 Hunt ..... A63H 33/38 446/72
5,965,182 A * 10/1999 Lindgren ..... A23G 9/00 426/805
6,098,571 A * 8/2000 Axelrod ..... A01K 5/0114 119/710
6,729,984 B2 * 5/2004 Silverglate ..... A63B 43/00 473/612
D524,500 S * 7/2006 Wai ..... B65D 81/368 206/769
D582,035 S * 12/2008 Morrison ..... A63B 45/00 D24/106
D596,248 S * 7/2009 Silverglate ..... D21/707
D604,370 S * 11/2009 Hume ..... A63B 43/00 D21/478
8,025,550 B2 * 9/2011 Tsengas ..... A01K 15/025 446/373
8,052,552 B2 * 11/2011 Silverglate ..... A63H 5/00 446/419
8,312,844 B2 * 11/2012 Mann ..... A01K 15/025 446/370
8,382,618 B2 * 2/2013 Lo ..... A63B 43/00 473/603
D690,376 S * 9/2013 Silverglate ..... A63H 5/00 D21/712
8,753,235 B1 * 6/2014 Daniel ..... A63B 45/00 473/603
8,764,588 B2 * 7/2014 Gill ..... A63B 59/50 473/465
D718,005 S * 11/2014 Hansen ..... A63B 43/00 D30/160
8,932,101 B2 * 1/2015 Silverglate ..... A63H 5/00 446/450
8,960,130 B2 * 2/2015 Willinger ..... A63H 33/00
D749,802 S * 2/2016 Crane ..... A63H 33/00
9,592,426 B1 * 3/2017 DiPietro ..... A63B 37/0056
D808,089 S * 1/2018 Wilson ..... A01K 5/0114 D30/160
D810,364 S * 2/2018 Wilson ..... A01K 5/0114 D30/160
9,992,975 B2 * 6/2018 Wolfe, Jr ..... A01K 5/0114
9,994,384 B2 * 6/2018 Glass ..... B65D 5/4204
9,999,573 B2 * 6/2018 Cross ..... A61J 9/06
10,085,422 B1 * 10/2018 Tsengas ..... A01K 15/025
D848,083 S * 5/2019 Fan ..... A63H 3/04 D30/160
10,792,227 B2 * 10/2020 Moran ..... A61J 9/0669
10,913,009 B2 * 2/2021 Hyslop ..... A63H 5/00
2008/0029429 A1 * 2/2008 Meger ..... B65D 81/368 206/769
2010/0056310 A1 * 3/2010 Silverglate ..... A63B 43/002 473/612
2012/0074029 A1 * 3/2012 Lantinen ..... B65D 85/60 206/524.7
2012/0238182 A1 * 9/2012 Gerber ..... A63H 11/10 446/279
2013/0019812 A1 * 1/2013 Rutherford ..... A01K 15/025 119/710
2013/0020317 A1 * 1/2013 Martin ..... A61J 9/0669 220/23.91
2016/0310856 A1 * 10/2016 Mitchell ..... A63H 33/00
2017/0007937 A1 * 1/2017 Elson ..... A63H 33/00
2019/0262732 A1 * 8/2019 Trakman ..... A63H 3/04
2020/0251081 A1 * 8/2020 Corder ..... G10K 3/00

* cited by examiner

CONTAINER SYSTEM FOR CONFECTIONERIES AND NOVELTY ITEMS

BACKGROUND OF THE INVENTION

1. Field of the Invention

This application claims priority to U.S. Provisional patent application Ser. No. 63/004,990, filed on Apr. 3, 2020, which included herein in its entirety by this reference thereto.

The invention herein disclosed relates generally to containers for confectioneries such as candy and treats and toys or novelty items. More particularly, it relates to a confectionery or novelty holding device having an ellipsoid container which is removably engageable within an interior of an elastic decorative surrounding exoskeleton housing formed as an animal or other whimsical configuration such as that employed in a story book or the like, by passage of the ellipsoid container therethrough.

2. Prior Art

BACKGROUND OF THE INVENTION

Confectioneries such as candy and other treats have been a favorite treat of both adults and children for centuries and small toys and novelty items have also been a favorite gift or collectable also favored by adults and particularly children. Modern confectionery and toy containers generally consist of boxes, tubes, bags, wrappers and other means for holding candy or confectionery pieces or toys or novelty items which have been manufactured and placed for sale or purchased and held by the buyer for consumption.

With respect to the above, before explaining at least one preferred embodiment of the container system herein, it is to be understood that the system invention is not limited in its application to the details of employment and to the arrangement of the components or the steps set forth in the following description or illustrated in the drawings. The various apparatus and methods and steps of the herein disclosed candy container system is capable of other embodiments, and of being practiced and carried out in various ways, all of which will be obvious to those skilled in the art once the information herein is reviewed.

Also, it is to be understood that the phraseology and terminology employed herein are for the purpose of description and should not be regarded as limiting. As such, those skilled in the art will appreciate that the conception upon which this disclosure is based may readily be utilized as a basis for other entertaining and educational candy container systems. It is important, therefore, that the embodiments, objects and claims herein, be regarded as including such equivalent construction and methodology insofar as they do not depart from the spirit and scope of the present invention.

SUMMARY OF THE INVENTION

The disclosed container system and device, herein, provides a decorative and educational container system which employs an ellipsoid interior housing portion having separable portions surrounding a housing interior cavity. The housing interior cavity is configured to hold a confectionery such as candy or other treats and/or a toy or novelty item therein.

The ellipsoid shaped housing portion is positionable within a body interior cavity of an elastic exoskeleton, only by passage of the housing through an opening formed in the exoskeleton body which has an opening diameter which is smaller than the housing diameter of the ellipsoid housing or container. By the term housing diameter as used herein is meant, the diameter of the housing at the position thereof which will contact the interior of the opening. By the term ellipsoid shaped housing portion as used, herein, is meant any globe or ball shape and any three dimensional shape of the exterior of the container which is formed by an ellipsoid shaped surface. That is to say, an ellipsoid shaped housing in a conventional definition, has three pair-wise perpendicular axes of symmetry which intersect at a center of symmetry, called the center of the ellipsoid. The line segments that are delimited on the axes of symmetry by the ellipsoid are called the principal axes or simply axes of the ellipsoid. If the three axes have the same length, the shape is round or globular. If the three axes have different lengths, the ellipsoid is said to be triaxial or rarely scalene, and the axes are uniquely defined. Thus, the exterior ellipsoid shape of the housing can be any curved exterior shape of the housing which is a globe, a ball, or essentially flattened versions thereof such as an egg or ellipse or elongated globe shape.

Thus, the housing of the container, herein, has a curved exterior surface of the sidewall thereof which surrounds the housing interior cavity. The sidewall, as noted, has an exterior curved shape such as that of a ball, globe or ellipsoid exterior shape such as that of an egg or other ellipse exterior. The housing of the container system herein also has a smallest diameter thereacross, which is sized to be larger than a diameter of one or all of a plurality of openings formed in an elastic exoskeleton through which the ellipsoid housing may be passed. Passage of the housing through such an opening will position it within, or remove it from, a biased contact with the sidewalls of the elastic exoskeleton which surround the interior cavity of the elastic exoskeleton.

The container system herein features such an ellipsoid shaped housing which is formed of two separable components. This housing is preferably formed having substantially rigid sidewalls defining the ellipsoid shape of the housing formed of the separable components. A housing interior cavity is formed by the engagement of a first half section of the housing with a second half section of the housing. This housing interior cavity is configured for holding confectioneries such as candy or toys or other novelty items therein. In the case of edibles, such as candy or confectionery items, such a positioning protects it from air exterior to the ellipsoid housing once formed by engaging the two half sections.

A current favored shape for the ellipsoid housing, as noted, above is a globe and particularly preferred is an egg shape. This is because opposing ends of such an egg shape have smaller cross sectional diameters than the central portion of the ellipsoid housing therebetween. This positioning of smaller cross sectional ends, in experimentation, has shown to make it easier for children, who are anticipated as a primary user of the container system herein, to push the housing through elastic openings in the sidewall of the elastic exoskeleton portion of the container.

Each of the first half section and second half section of the container is formed as one half of the resulting ellipsoid or egg shaped housing. Separable connectors or fasteners positioned along the perimeter edge of each of the first half section and second half section, are removably engageable, and reengageable, to form the interior housing. Such separable connector or fasteners, particularly preferred, are a recess in one half section which is engageable with a complementary projection from the other half section.

The exterior of the body of the container device herein, is formed of a polymeric or otherwise elastic material such as thermoplastic rubber or an other elastic material which one skilled in the art will employ which will stretch and return substantially to its un-stretched original shape. A particularly preferred configuration for the exterior body is that of an animal such as a mammal or fish or the like. However, other whimsical shapes may be employed such as a coach or a windmill or other shape which might be part of a story or fairy tale to which the container device herein is employed or related.

An exoskeleton body is formed with a torso area having a flexible and elastic sidewall which surrounds and defines a shape of an interior chamber of the exoskeleton body. In one preferred mode, a plurality of openings communicating through this sidewall forms one or more passages communicating with the interior chamber. These openings in the preferred mode of the elastic exoskeleton of the container device all have diameters or largest cross sectional areas of the openings which are narrower than the widest portion of the ellipsoid or egg shaped housing.

Some of the plurality of openings may be formed of a polymeric elastic material of a size which limits the elasticity and ability to stretch these openings. Others may be formed in a diameter size which will allow those openings, to stretch sufficiently to allow passage of the widest diameter area of the interior housing to pass therethrough for positioning thereof within the interior chamber of the elastic exoskeleton body, and/or removal therefrom.

The exterior elastic exoskeleton body may be provided in a kit of such exterior bodies, each having a different shape and appearance when viewed. For example, one may have the shape and appearance of a dinosaur and one of the plurality may have the appearance and shape of a fish or other animal. There is no limitation on the shapes and appearances of the plurality of such exterior exoskeleton bodies provided in a kit. However, the interior chamber of each should be configured to hold the interior housing therein, preferably in a biased compressive engagement of the elastic material therearound.

In use, the container device will hold confectioneries or candy or toys within the interior chamber of the ellipsoid housing. The housing with the candy or other contents therein will be operatively positioned within the interior chamber of the elastic exoskeleton body in the chosen shape and appearance thereof. The user, to reach the candy or toy or the like held within the interior cavity of the ellipsoid housing, will need to ascertain or choose one of the openings in the sidewall of the exterior exoskeleton body which will stretch to accommodate passage and removal of the interior housing therethrough.

Once the ellipsoid housing is removed, the two half portions may be separated from their removable engagement, and the confectionery, candy or toy or the like within the interior chamber can be accessed and eaten or played with. The container device can thereafter be reassembled by re engaging the two half portions of the housing, and reinserting the housing back into the interior chamber of the exoskeleton body.

With respect to the above description, before explaining at least one preferred embodiment of the candy container and system herein, it is to be understood that the invention is not limited in its application to the details of operation nor the arrangement of the components or the steps set forth in the following description or illustrations in the drawings. The various methods of implementation and operation of the method herein are capable of other embodiments and of being practiced and carried out in various ways which will be obvious to those skilled in the art once they review this disclosure. Also, it is to be understood that the phraseology and terminology employed herein are for the purpose of description and should not be regarded as limiting.

Therefore, those skilled in the art will appreciate that the conception upon which this disclosure is based may readily be utilized as a basis for designing of other methods and systems for carrying out the several purposes of the present candy container and system. Therefore, that the objects and claims herein should be regarded as including such equivalent construction, steps, and methodology insofar as they do not depart from the spirit and scope of the present invention.

It is an object of this invention to provide a novel and decorative container that functions as a toy or puzzle when an ellipsoid container is engaged within an elastic exoskeleton body portion.

These together with other objects and advantages, which become subsequently apparent reside in the details of the construction and operation of the system herein as more fully hereinafter described and claimed, reference being had to the accompanying drawings forming a part thereof, wherein like numerals refer to like parts throughout.

Further objectives of this invention will be ascertained by those skilled in the art as brought out in the following part of the specification wherein detailed description is for the purpose of fully disclosing the invention without placing limitations thereon.

BRIEF DESCRIPTION OF DRAWING FIGURE

DETAILED DESCRIPTION OF THE PREFERRED EMBODIMENTS OF THE INVENTION

Figure 1:
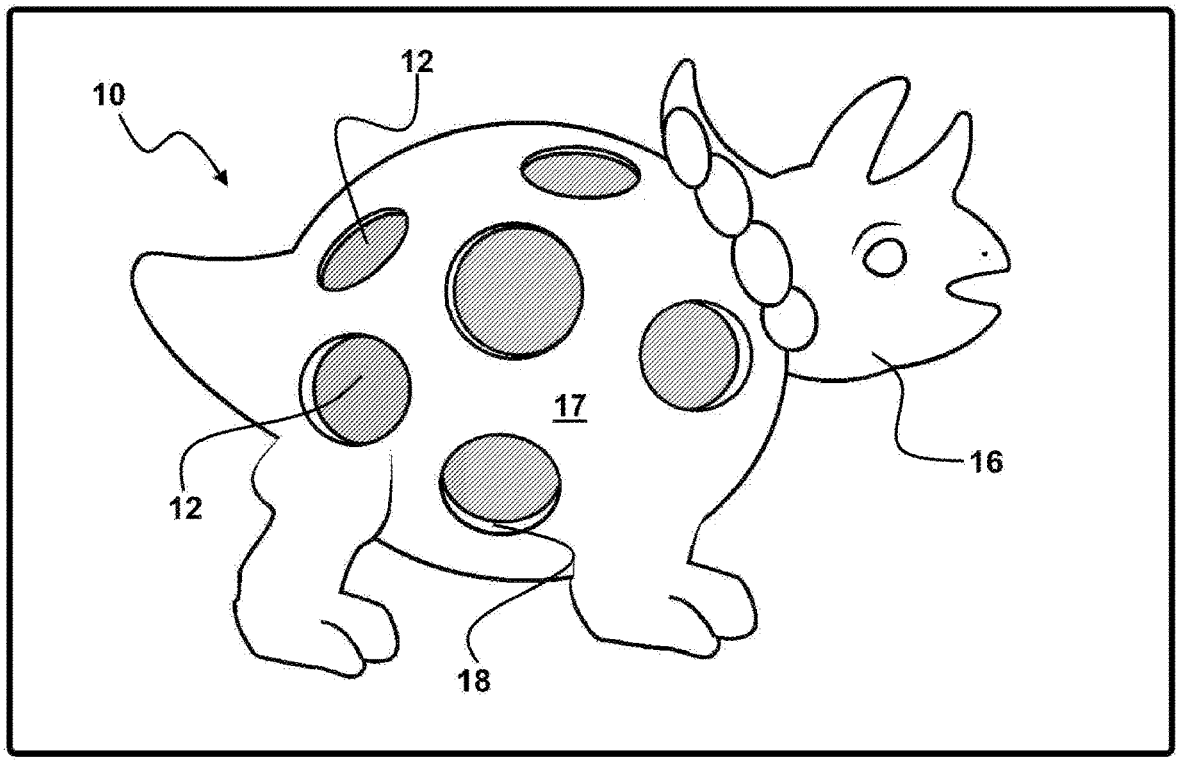
FIG. 1 depicts the container herein in a fully assembled configuration with the housing operatively positioned within the interior chamber of the elastic exoskeleton body of the device.

Referring now to the container device 10 herein shown in simple format by the depictions of FIGS. 1-22, there is seen in FIG. 1, the container device 10 in a fully assembled configuration. As shown, a housing 12 is located within the interior chamber 14 of an exterior body 16 formed as an elastic exoskeleton which surrounds the housing 12, once positioned in the engaged or mounted position within the interior chamber 14.

The body 16 is formed of an elastic polymeric material which is flexible and somewhat elastic but will maintain a static shape and positioning when not under force to stretch. As shown, the exoskeleton or body 16 is preferably formed in the shape of an animal or other whimsical configuration. The elastic exoskeleton body 16, of course, can be formed in any animal shape or other novelty shape, so long as it has one or more openings 18 through the sidewall 17 surrounding the interior chamber 14, which communicate between the exterior of the body 16 or elastic exoskeleton where at least one of those openings 18 is sized to enlarge when stretched and thereby allow passage of the housing 12 therethrough and into a mounted position within the interior chamber 14.

Figure 2:
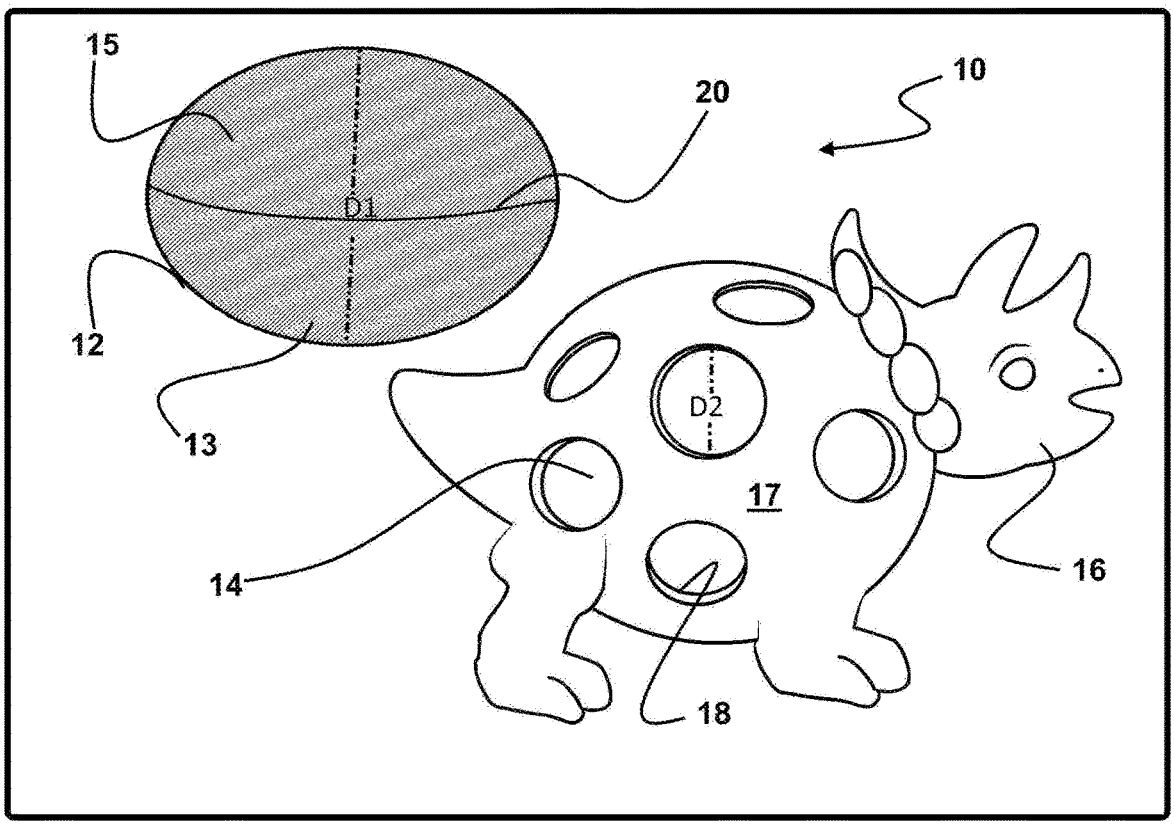
FIG. 2 shows the device of FIG. 1, depicting the removed housing which holds confectionery such as candy or toys or the like therein, from the interior chamber of the elastic exoskeleton body of the device and shows the housing diameter D1 being larger than the hold diameter D2 through which it must pass.
Figure 3:
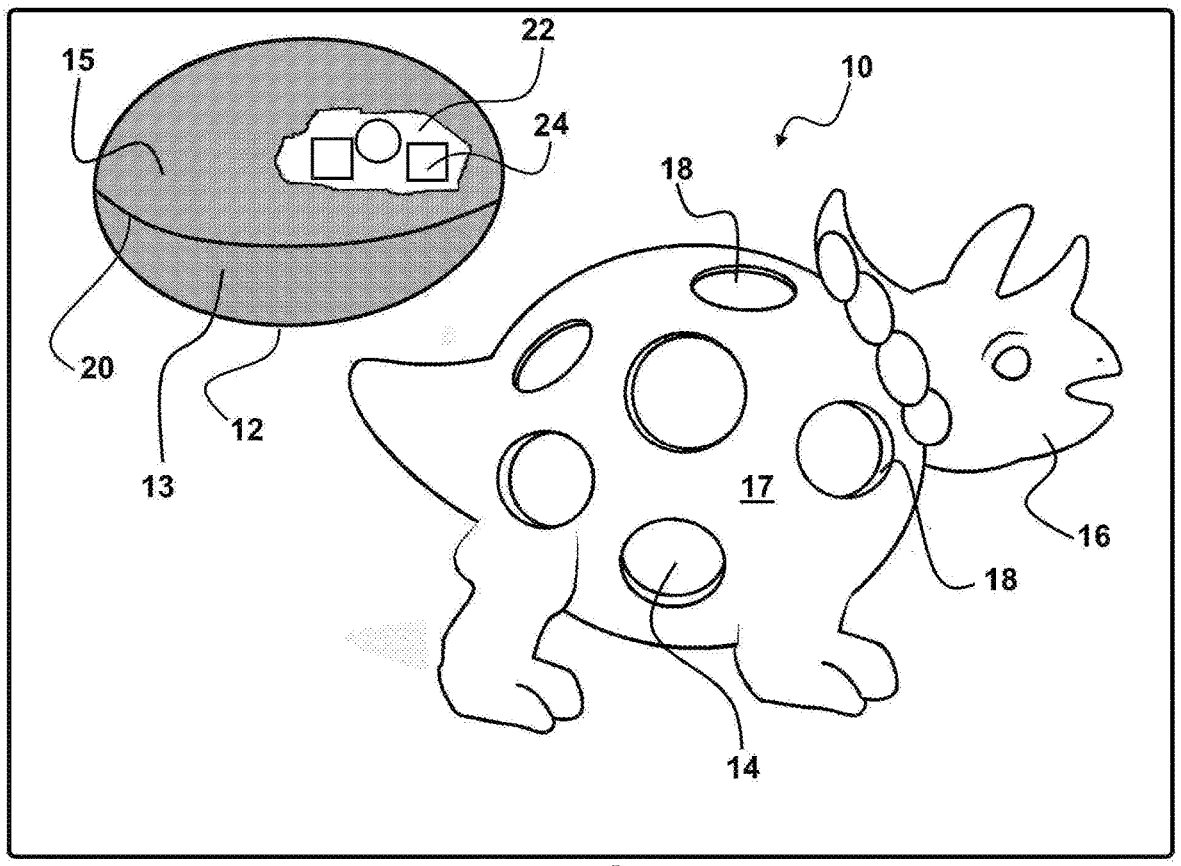
FIG. 3 depicts the housing being removed, and showing the interior cavity holding the consents such as confectioneries, candy or toys therein.
Figure 21:
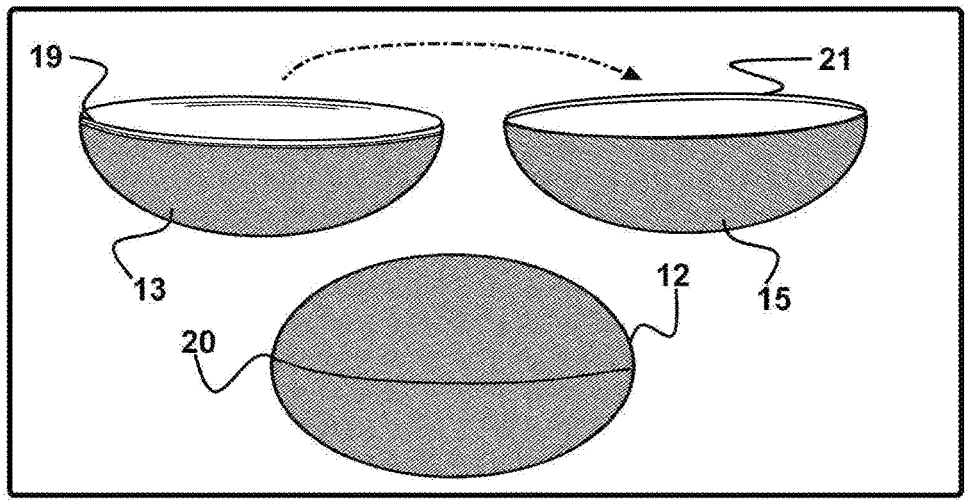
FIG. 21 shows the container formed for two half portions having complimentary fasteners thereon which hold the two half portions removably engaged.

Such an ellipsoid shaped housing 12 is shown in FIGS. 2 and 3, for example, in a removed positioning exterior to the interior chamber 14. The housing 12 is preferably formed of at least two half sections 13 and 15 (FIG. 21) which are removably engageable, such as by mating connectors along a mating engagement edge 20 of both the two half sections 13 and 15. Such a mating engagement edge 20, for example, may be a ridge 19 on a first half section 13 which frictionally engages within a recess 21 formed on the mating engagement edge 20 of the second half section 15 (FIG. 21).

Also shown in FIGS. 2-20, the device 10 herein has the elastic exoskeleton or body 16 with at least one, and preferably a plurality of openings 18, which communicate through the sidewall 17 of the elastic exoskeleton defining the body 16. Each such body 16 has an interior chamber 14 positioned therein and surrounded by the sidewall 17. As noted, the openings 18, if formed in the sidewall 17, preferably have an opening diameter D2 thereof in the elastic exoskeleton forming the sidewall 17 and body 16, which is sufficiently elastic to allow the communication of the assembled housing 12, at the housing diameter D1 thereof, into and out of the interior chamber 14. The material forming the body 16 is, thus, polymeric and elastic such that once stretched to allow insertion or removal of the housing 12, the elastic exoskeleton forming the body 16 retracts toward a return to its original size and shape.

In one mode of the device 10, the opening 18, allowing such passage, may not be one of the plurality of openings 18 when viewed, appears as the opening with the largest diameter. It may be a diameter smaller than that of surrounding openings 18 or the smallest diameter opening 18. However, the elastic material forming the sidewall 17 of the exoskeleton or body 16 surrounding that opening 18 is formed thinner and more elastic than thicker elastic material surrounding the remainder of openings 18 in the sidewall 17. Such will thereby render the device 10 to define puzzle or game, where the user must ascertain which opening 18 to use to remove or insert the housing 12, which may not be that with the largest diameter.

As can be seen in FIG. 3, the two half sections 13 and 15, forming the ellipsoid shaped housing 12 removably connect along respective edges along the engagement edge 20. In this engaged configuration, the housing 12 is formed and has an interior cavity 22 in which confectioneries, or candy or toys or other contents 24 is positioned. Once the user has managed to figure out how to remove the housing 12 from the interior chamber 14 of the elastic exoskeleton or body 16 through an opening 18, they can ascertain how to separate the two half sections 13 and 15 of the interior housing 12 to provide access to the contents 24 within the interior cavity 22. By contents 24 is meant candy, toys, game parts, confectioneries, prizes, items related to a book accompanying the device 10, or other contents 24 as would occur to those skilled in the art. Currently, particularly preferred as contents 24, is candy whereby the shape of the elastic exoskeleton or body 16 is in an animal shape, or the shape of a seasonal item such as a bunny for Easter, or a pumpkin for Halloween.

Figure 4:
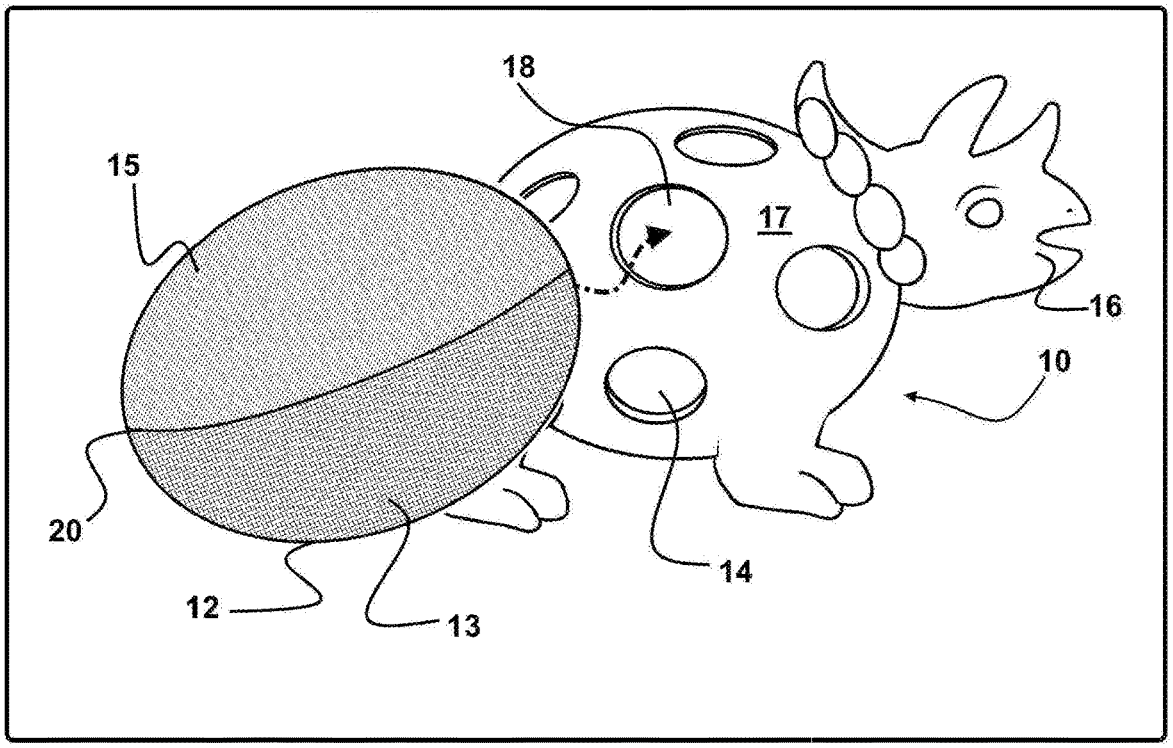
FIG. 4 depicts the act of reinsertion of the ellipsoid housing into the interior chamber of the decorative elastic exoskeleton body by inserting it into the interior chamber through one of a plurality of openings formed in the elastic sidewall of the exoskeleton body surrounding the interior chamber thereof.

Shown in FIG. 4, is the ellipsoid shaped housing 12 subsequent to having both half sections 13 and 15 reengaged along the engagement edge 20 of each, and ready for reinsertion into the interior chamber 14 of the elastic exoskeleton or body 16. In this step, the user must ascertain the best opening 18 for reinsertion of the assembled housing 12, back into the interior chamber 14 of the elastic exoskeleton or body 16. Once so inserted, the device 10 will appear as in FIG. 1, as an animal or other novel shaped structure which one or more openings 18 therein, wherein the exterior surface of the housing 12, in this mounted or engaged positioning, will appear as part of a singular structure of the device 10. If the exterior of the housing 12 is formed with one color, and the elastic material forming the exoskeleton or body 16 is formed of a different color, the assembled device 10 will appear as having polka dots.

Figure 5:
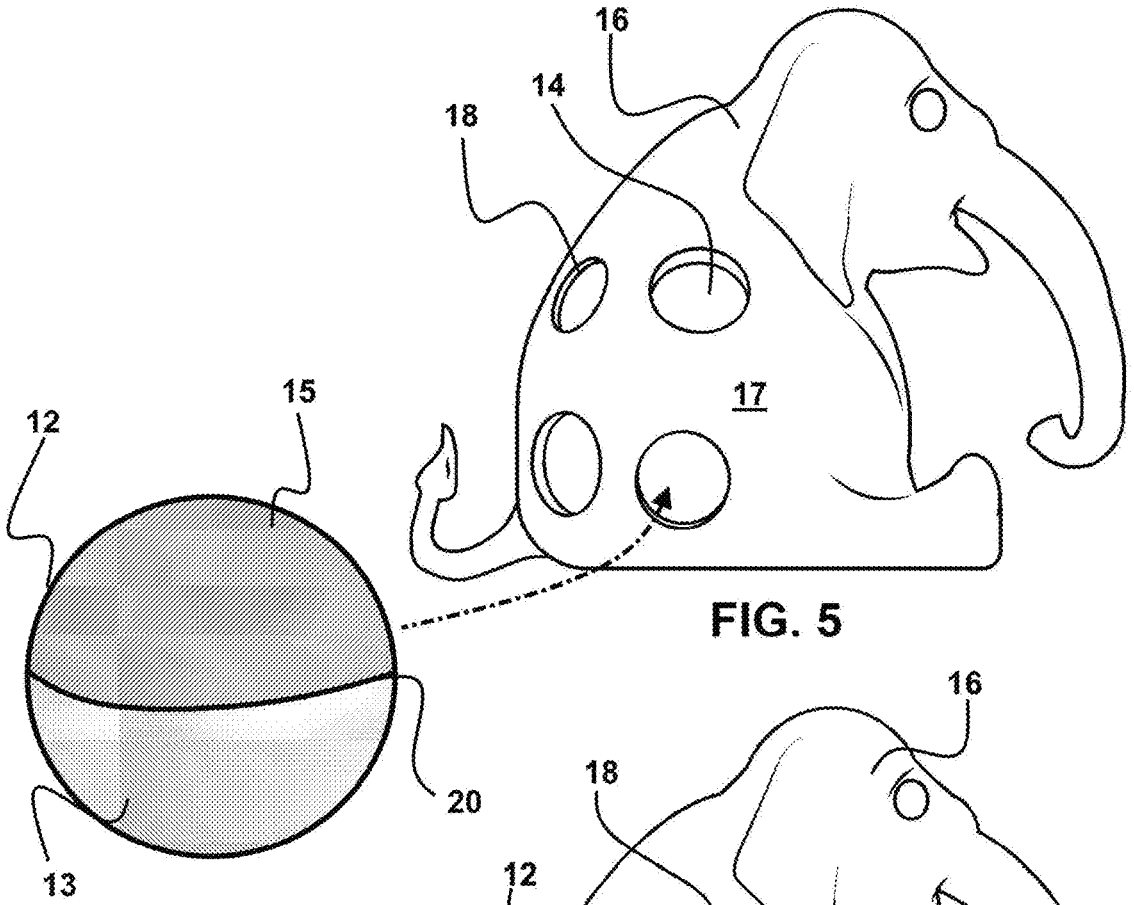
FIG. 5 depicts another mode of the container device showing the exoskeleton body formed as an animal such as an elephant and the elastic opening through which an ellipsoid shaped container is insertable or removable.
Figure 6:
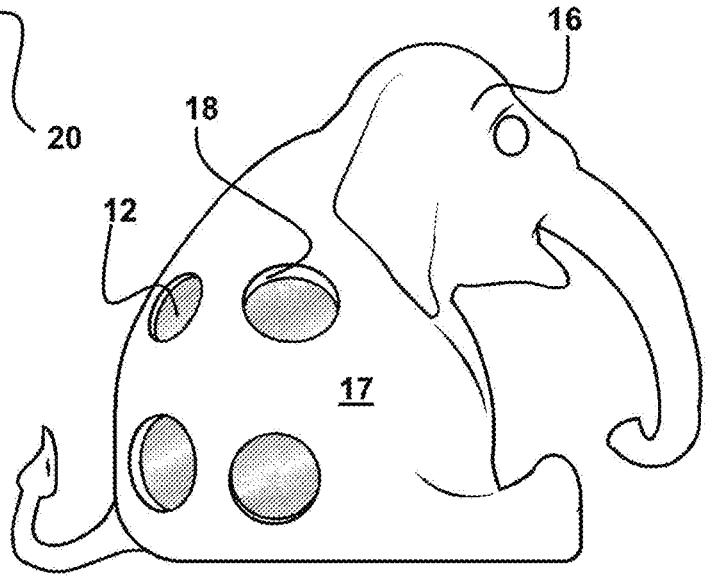
FIG. 6 shows the device as in FIG. 4 with the container in a mounted position within the an the interior chamber of the elastic exoskeleton body.
Figure 7:
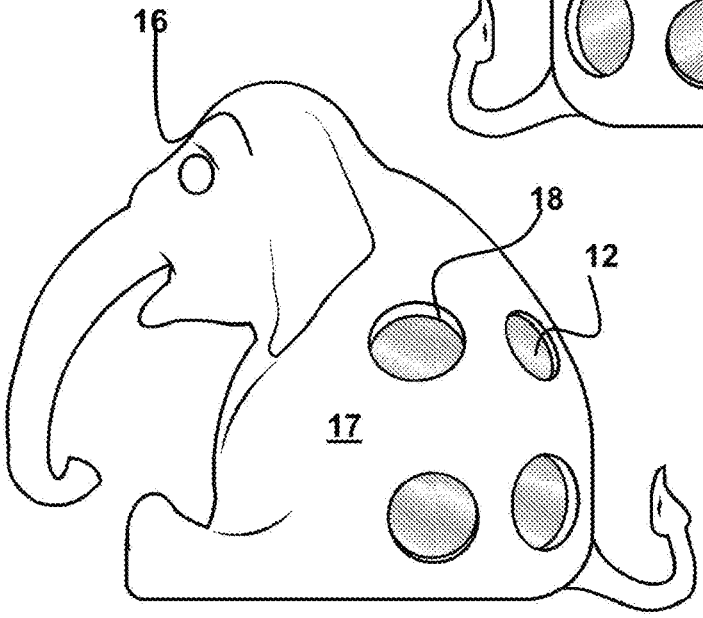
FIG. 7 shows an opposite side view of the device as in FIG. 6.

Shown in FIGS. 5-7, are a mode of the device 10 herein where the elastic exoskeleton or body 16 is formed as an animal such as an elephant. This mode of the device 10 operates and is formed in the same fashion as the above noted modes, wherein the elastic exoskeleton or body 16 is formed in the appearance of the animal or object of choice and is formed of an elastomer or elastic material such as thermoplastic rubber which is currently a particular favored elastic material for formation of the elastic exoskeleton defining the body 16. An elastomer material such as thermoplastic rubber has shown in experimentation to remain pliable and soft even when stretched over and providing a biased contact against the exterior of the housing 12 in the engaged or mounted position within the interior chamber 14.

This biased contact is provided by forming the size or volume of the interior cavity 14, smaller than the size or volume of the housing 12 defined by the exterior surface of the housing 12. Thus, the housing 12, where formed larger in volume and size than the volume of the interior chamber 14, will be rendered to a biased contact with the sidewalls 17 of the body 16 once the housing 12 is inserted therein through an opening 18.

This biased contact is preferred to render the housing 12 to a fixed and non-movable positioning within the interior cavity 14 and to provide a biasing force to maintain the first half section 13 engaged to the second half section 15 forming the housing 12 during transport and storage. Additionally, the shape of the exterior of the housing 12 can be formed to expand the sidewalls 17 of the body 16 where an exaggerated shape is desired such as a pot belly for an animal such as in FIG. 9.

The elastomer property of the material forming the exoskeleton or body 16, in addition to providing a biased contact of the sidewalls 17 and body against the exterior surface of the housing 13, provides padding around the engaged housing 12 protecting it from damage during shipment or dropping, or if small children toss the device 10 at others as small children are inclined to do during play. However, other elastomer materials having the elasticity by virtue of which the body 16 will tend to recover its original size and shape after deformation can be employed.

Also shown in FIGS. 5-20 is that the elastic exoskeleton or body 16 may be formed in any of an infinite number of shapes of animals or objects such as a pumpkin or any other object, and have the openings 18 therein for positioning of the housing 12 within an interior chamber 14 of the formed elastic exoskeleton or body 16. The device 10, as such, is anticipated not only for use as a container for contents 24 such as candy or game parts or confectionery by itself, but also as an accompaniment to a media 30, such as a book or video. In accompanying media 30, such as a video or storybook, the bodies 16 are formed as one, or in a plurality of shapes in the kit 11 (FIG. 22) which would be provided with or sold or provided as an optional related accompaniment to the game or video. In such a kit 11, there will be at least one elastic exoskeleton or body 16 and preferably a plurality thereof, which have the shapes of the bodies 16 in the kit 11 being that of the story or video characters. For example, for a story about dinosaurs, the bodies 16 will be shaped to that of those in the story or video.

Figure 8:
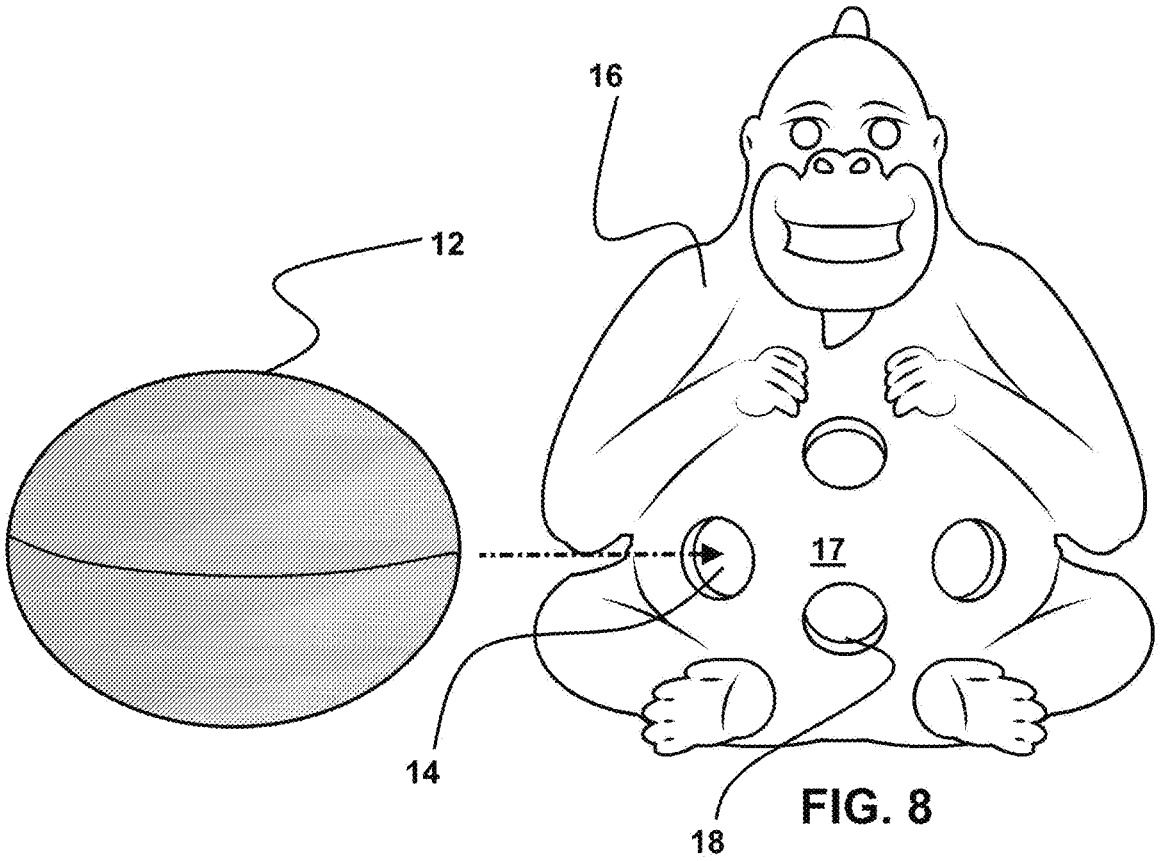
FIG. 8 shows the container device herein with the elastic exoskeleton body formed as an animal, such as a monkey, and showing an opening in the elastic exoskeleton or body through which the container may be passed.
Figure 9:
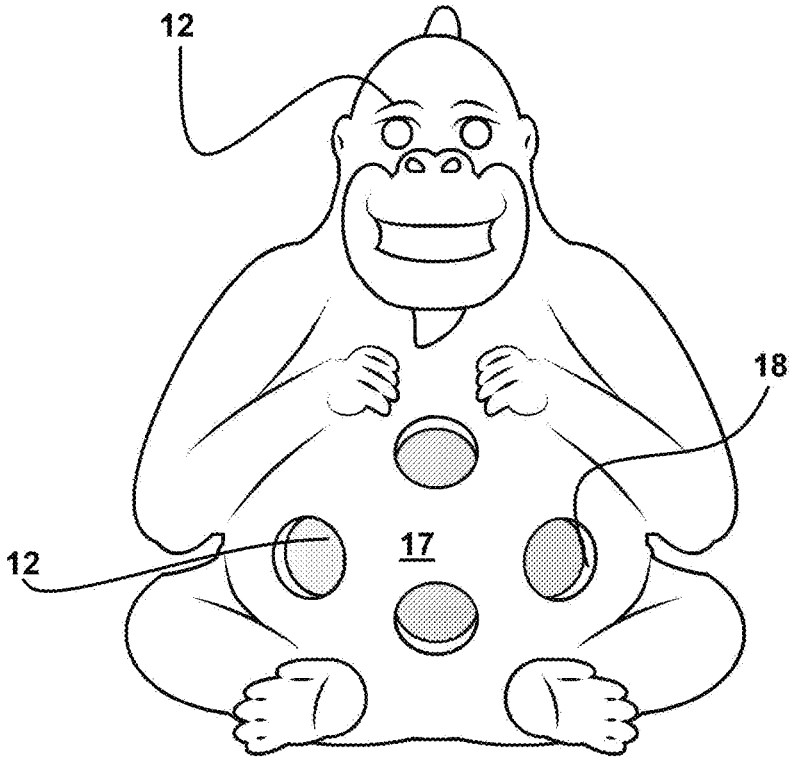
FIG. 9 shows the device of FIG. 8 with the container in the mounted position within the interior chamber of the exoskeleton or body.
Figure 10:
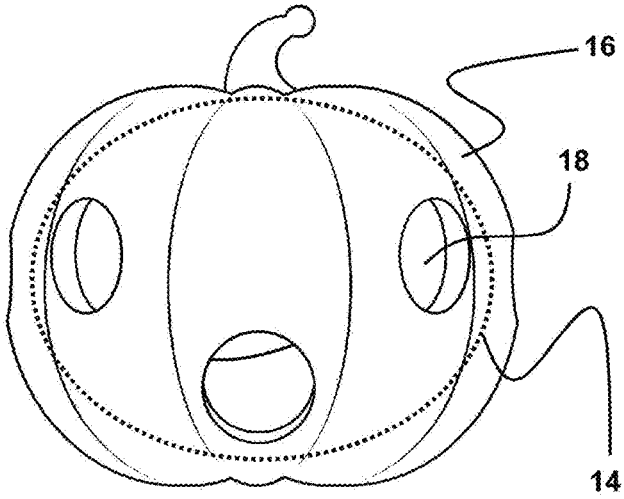
FIG. 10 shows a mode of the device where the interior chamber, shown in dotted line, is positioned within the elastic exoskeleton body shaped as a pumpkin.
Figure 11:
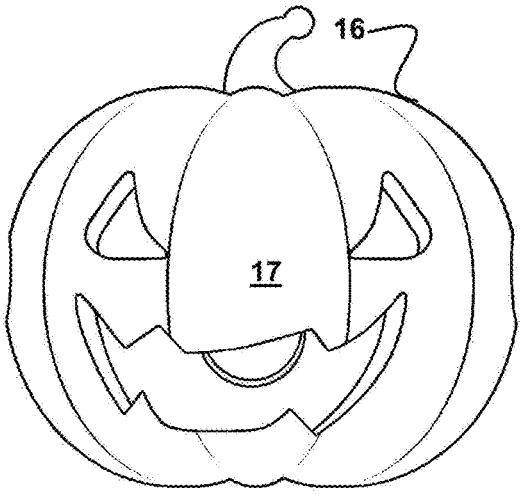
FIG. 11 shows the device of FIG. 10 from the front side opposite the rear shown in FIG. 10.
Figure 12:
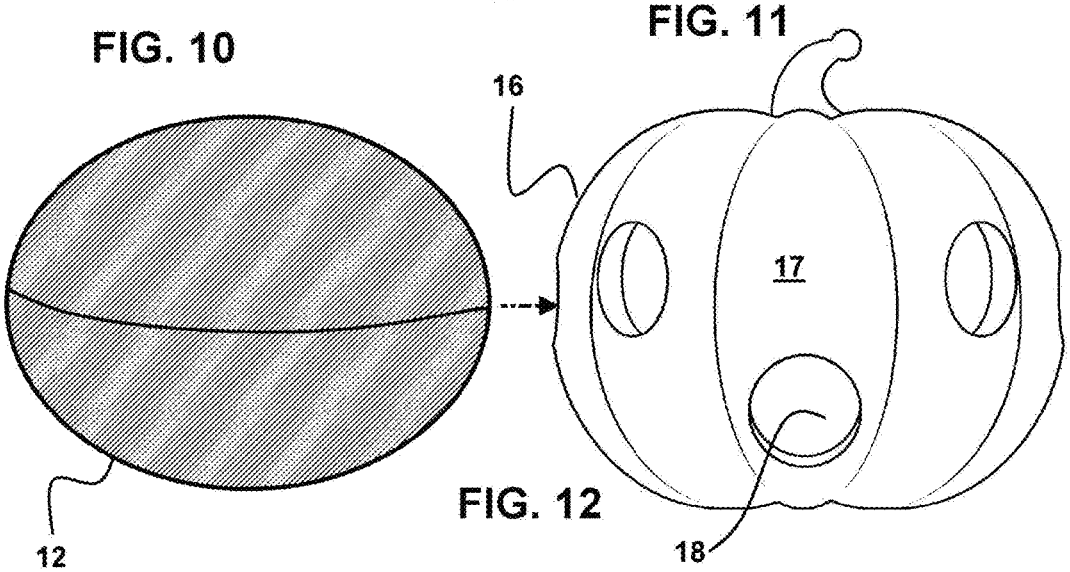
FIG. 12 shows the opening in the elastic exoskeleton or body of the device of FIGS. 10-11 through which the container may be passed into or out of the interior chamber.
Figure 13:
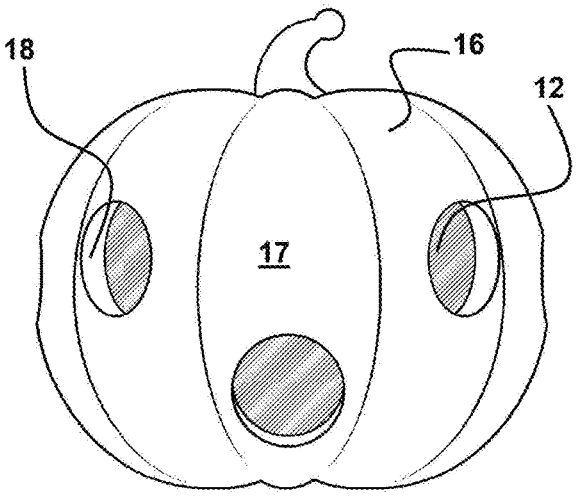
FIG. 13 shows the device of FIGS. 10-12 in a rear view, having the container in a mounted or engaged position within the interior chamber of the elastic exoskeleton.
Figure 14:
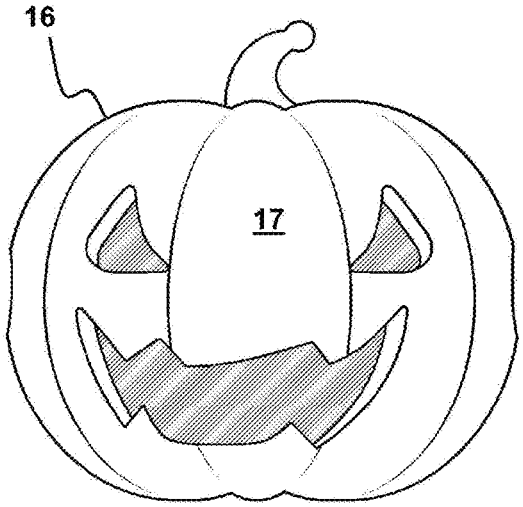
FIG. 14 shows the device of FIGS. 10-12 in a frontal view, having the container in a mounted or engaged position within the interior chamber of the elastic exoskeleton.
Figure 15:
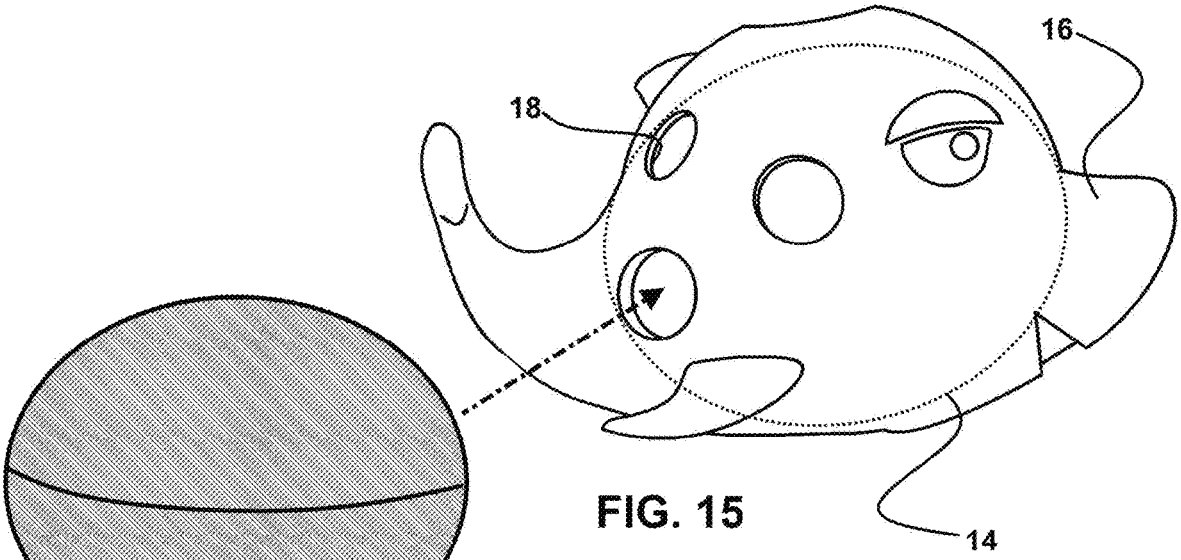
FIG. 15 shows an opening in the elastic exoskeleton or body of the device which is shaped as a fish, through which the container may be passed into or out of the interior chamber thereof.

Shown in FIGS. 8-9 are depictions of the device 10 herein wherein the elastic exoskeleton body 16 is formed to appear as an animal such as a monkey. Also shown in FIG. 9 is the housing 12 positioned in the mounted or engaged position within the interior chamber 14 of the body 16. As noted, the shape of the housing 12 could be formed to stretch the sidewalls 17 in areas where an exaggerated shape such as a pot belly or muscular physique is desired.

FIGS. 10-14 show depictions of the device 10 wherein the elastic exoskeleton or body 16 has an interior chamber 14 shown in dotted line, which is positioned within the elastic exoskeleton body 16 which is shaped to appear as a pumpkin or jack o lantern as a seasonal character. By seasonal character is meant a shape of the body 16 which depicts that of a character commonly used or related with a holiday or season of the year. The shape of the body 16, for example might also be formed to match that of a seasonal character such as the Easter bunny or a Christmas reindeer or a heart for Valentines day, or a body 16 having another shape which is related to a seasonal character.

Figure 16:
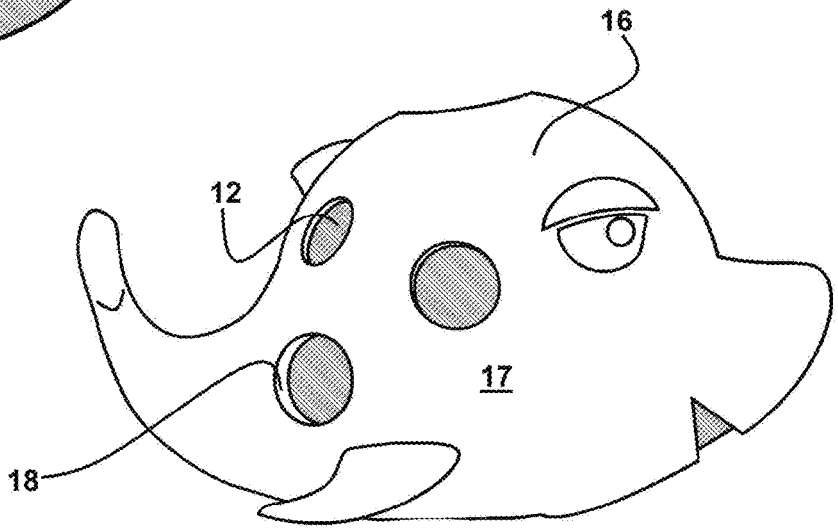
FIG. 16 depicts the device as in FIG. 15 showing the container in the mounted or engaged position within the interior chamber of the exoskeleton or body of the device.
Figure 17:
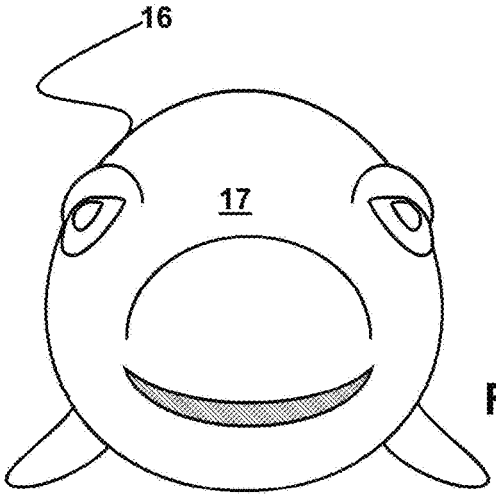
FIG. 17 shows a frontal view of the device as in FIG. 16.

FIGS. 16-17 depict the device 10 herein wherein the elastic exoskeleton or body 16 is formed in the shape of a fish and surrounds the interior chamber 14 into which a housing 12 is inserted through an opening 18. As noted, the volume or size of the interior chamber 14 may be smaller than the exterior size of the housing 12, and thereby form a biased contact of the sidewalls 17 against the exterior surface of the housing 12.

Figure 18:
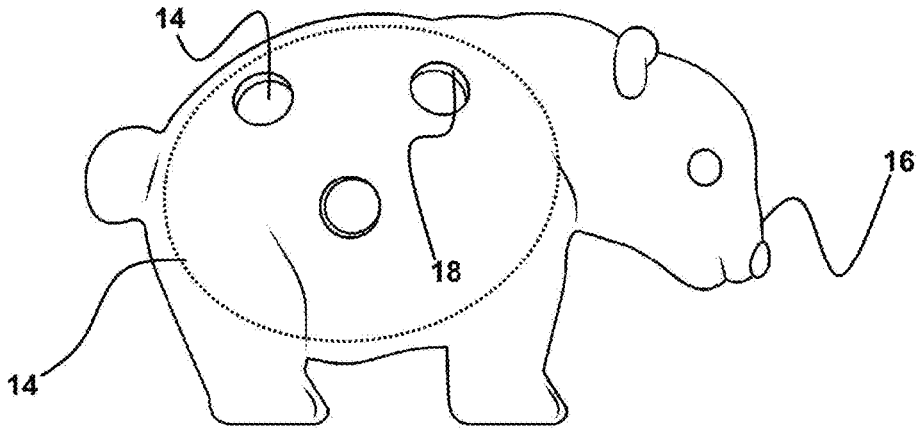
FIG. 18 shows the elastic exoskeleton or body of the device which is shaped as an animal such as a bear and shows the interior chamber in dotted line.
Figure 19:
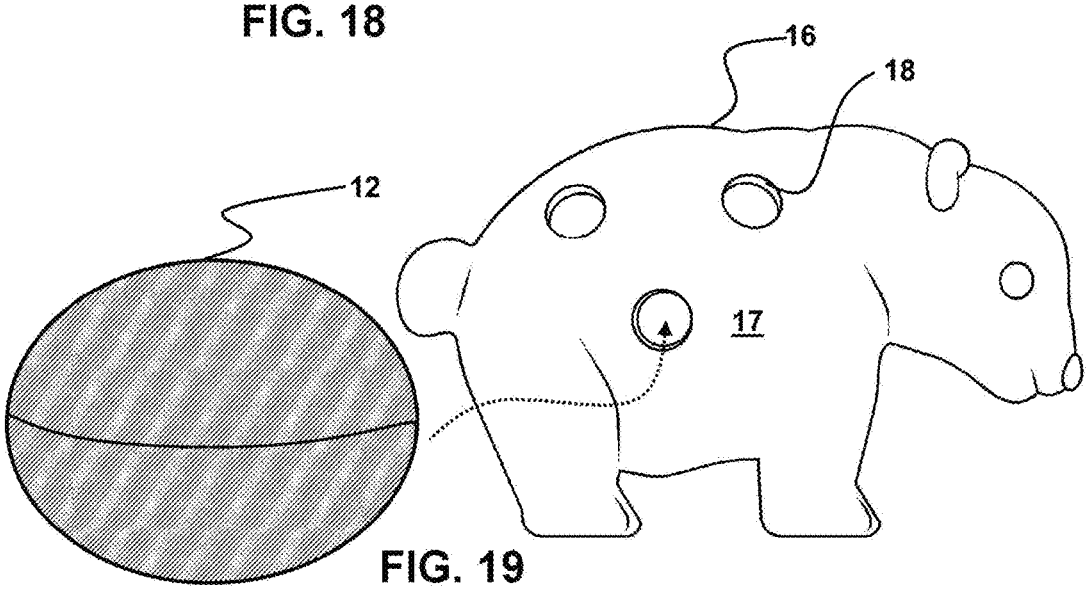
FIG. 19 shows an opening in the elastic exoskeleton or body of the device of FIG. 18, thorough which the container may be passed into or out of the interior chamber thereof.
Figure 20:
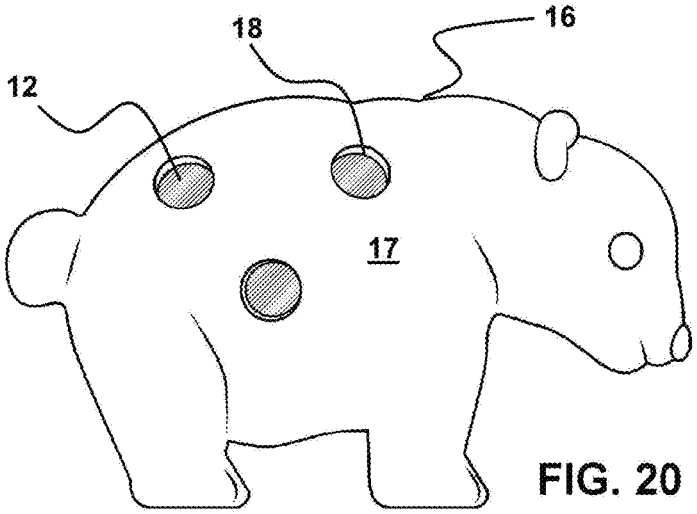
FIG. 20 shows the device of FIGS. 18-19 having the container in a mounted or engaged position within the interior chamber.

FIGS. 18-20 depict the device 10 herein wherein the elastic exoskeleton or body 16 is formed in the shape of a bear and surrounds the interior chamber 14 into which a housing 12 is inserted through an opening 18. As noted the volume or size of the interior chamber 14 may be smaller than the exterior size of the housing 12, and thereby form a biased contact of the sidewalls 17 against the exterior surface of the housing 12.

As noted above, shown in FIG. 21, is a depiction of the container 12 in an assembled form. The container 12 is formed of a first half portion 13 and a second half portion 15 which are removably engageable to each other to form the container 12. Such a removable engagement may be by complimentary connectors such as a ridge 19 on a first half section 13 which frictionally engages within a recess 21 formed on the mating engagement edge 20 of the second half section 15. This removable engagement allows the user to access the contents 24 within the interior cavity 22 of the container 12.

Figure 22:
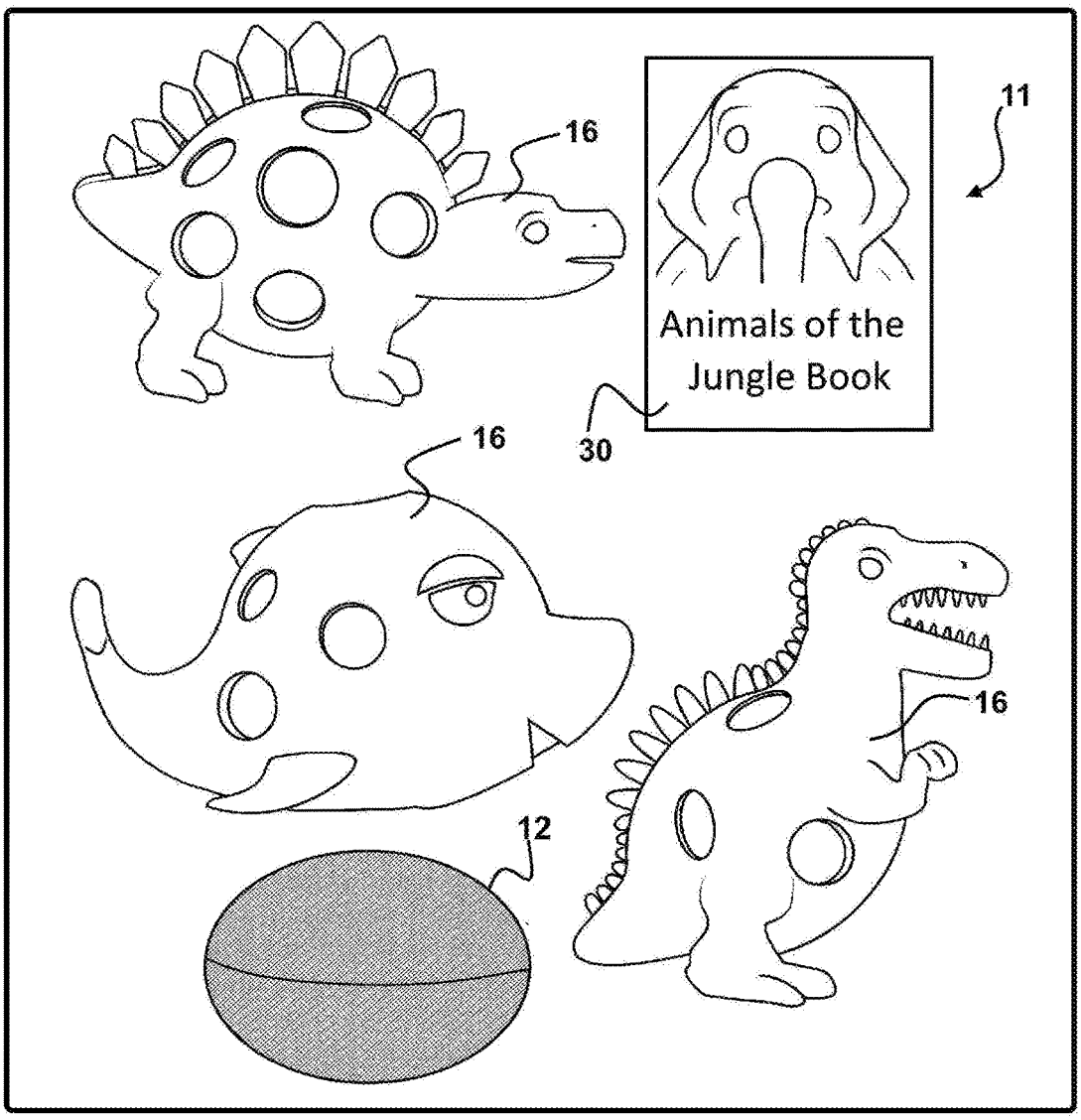
FIG. 22 shows the container device herein provided as a kit of differing shaped elastic exoskeleton bodies into which the container is positionable to the engaged or mounted position with the interior chamber of each, such as could be provided along with a book where the exoskeletons are characters in the book or as an ongoing collectable.

Shown in FIG. 22 is the container device 10, herein, provided as a kit 11 of differing shaped elastic exoskeleton bodies 16 into which the container 12 is positionable to the engaged or mounted position with the interior chamber 14 of each body 16. As noted, this mode of the device 10 may be provided in sequence by provision of individual bodies 16 of the kit over time or can be provided for use in combination with visual media 30 book, cartoon, movie, or video, where the exoskeleton or bodies 16 are formed to depict characters in the book or video media 30 and the contents 24 can be also related thereto.

While all of the fundamental characteristics and features of the container herein have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. A container comprising:

an elastic exoskeleton having sidewalls surrounding an interior chamber of said elastic exoskeleton;

a first opening formed in said elastic exoskeleton, said first opening having an opening diameter, said first opening communicating with said interior chamber;

a housing, said housing having an exterior surface defining an exterior shape of said housing and having an interior cavity therein, said interior cavity configured for holding a contents therein;

said housing having a housing diameter, said housing diameter being larger than said opening diameter;

said housing positionable within said interior chamber to a mounted position, by an insertion of said housing through said first opening which imparts a stretching to said first opening during said insertion;

said interior chamber being smaller than an exterior of said housing defined by said exterior surface thereof; and said sidewalls imparting a biased contact against all of said exterior surface of said housing with said housing in said mounted position.

2. The container of claim 1, additionally comprising:

said exterior shape of said housing being ellipsoid; and said housing having a first half portion in a removable connection to a second half portion.

3. The container of claim 2, additionally comprising:

said first opening in said elastic exoskeleton being one of a plurality of openings; and said housing positionable within said interior chamber to said mounted position, only by a said insertion of said housing through said first opening, whereby a puzzle is provided for a user to discern the single manner to position said housing into said elastic exoskeleton is solely through said first opening.

4. The container of claim 1, additionally comprising:

said first opening in said elastic exoskeleton being one of a plurality of openings; and said housing positionable within said interior chamber to said mounted position, only by a said insertion of said housing through said first opening, whereby a puzzle is provided for a user to discern the single manner to position said housing into said elastic exoskeleton is solely through said first opening.

5. The container of claim 1, additionally comprising:

said elastic exoskeleton forming a body shape surrounding container, said body being an animal shape.

6. The container of claim 5, additionally comprising:

a plurality of said elastic exoskeletons each forming a said body shape in a different said animal shape.

7. The container of claim 5, additionally comprising:

said body shape being an animal shape depicted in a book or video provided in combination with said container.

8. The container of claim 5, additionally comprising:

said contents of said interior cavity being candy.

* * * * *